United States Patent [19]

Mosser

[11] Patent Number: 4,805,583

[45] Date of Patent: Feb. 21, 1989

[54] SLING APPARATUS

[76] Inventor: Kenneth J. Mosser, P.O. Box 242, Clarissa, Minn. 56440

[21] Appl. No.: 20,862

[22] Filed: Mar. 2, 1987

[51] Int. Cl.[4] ..... A63B 53/00

[52] U.S. Cl. ..... 124/20 R; 124/17; 273/162 R; 403/362; 403/377

[58] Field of Search ..... 124/17, 20 R, 22, 16, 124/21; 273/162 R, 77 R, 77 A; 403/362, 377

[56] References Cited

U.S. PATENT DOCUMENTS

| | | | |
|---|---|---|---|
| D. 226,203 | 1/1973 | Gibbs et al. | 273/162 R X |
| 707,000 | 8/1902 | Pease | 124/17 |
| 1,072,988 | 9/1913 | Pratt et al. | 124/20 R |
| 2,823,483 | 2/1958 | Malott | 124/20 R |
| 3,102,526 | 9/1963 | Connor | 124/21 |
| 3,341,203 | 9/1967 | Brill | 403/362 |
| 3,858,989 | 1/1975 | Field | 403/362 |
| 3,907,334 | 9/1975 | Schera, Jr. | 403/362 |
| 3,949,729 | 4/1976 | Pfotenhauer | 124/22 |
| 4,014,126 | 3/1977 | Sameuls et al. | 124/20 R |
| 4,314,771 | 2/1982 | Lambert | 403/362 |

*Primary Examiner*—Randolph A. Reese
*Assistant Examiner*—Anthony Knight
*Attorney, Agent, or Firm*—Burd, Bartz & Gutenkauf

[57] ABSTRACT

An apparatus for slinging and putting an object that has an elongated cylindrical shaft which accommodates a spurred putter head and a sling assembly on opposite ends thereof. A hand grip is provided on the shaft to hold the apparatus in a desired position. The object is directed toward a desired target by positioning the spur of the putter head into the ground and drawing and releasing the sling while the shaft is held at the desired angle. When the object is on a putting surface, the apparatus is converted into a putter by removing the sling section from the apparatus. The apparatus can be converted into a firearm target thrower by substituting a staked end section for the putter section. When the staked end is implanted into the ground, the sling is used to propel objects into the air for firearm shooting practice.

18 Claims, 3 Drawing Sheets

FIG. 7
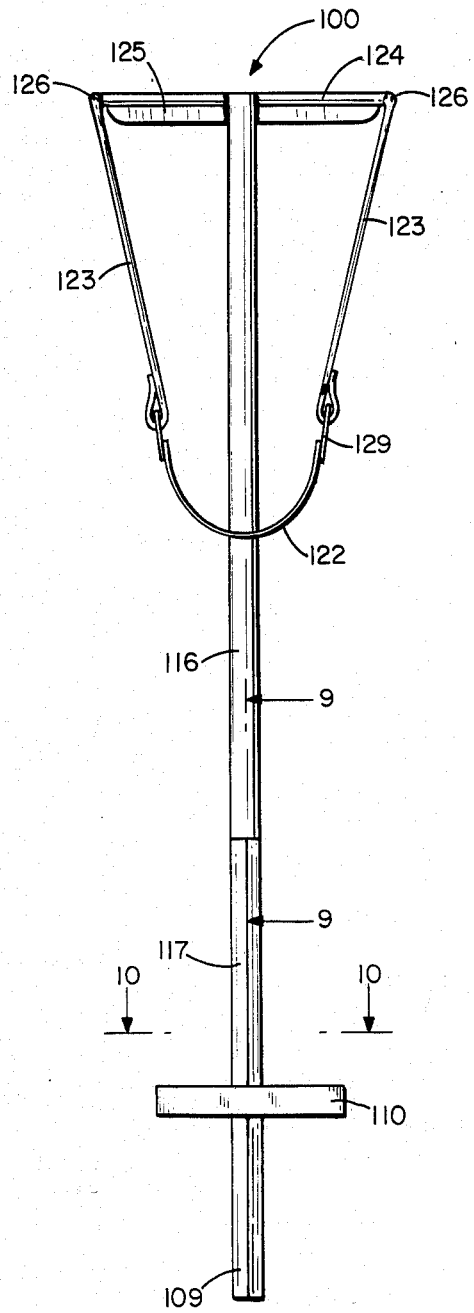
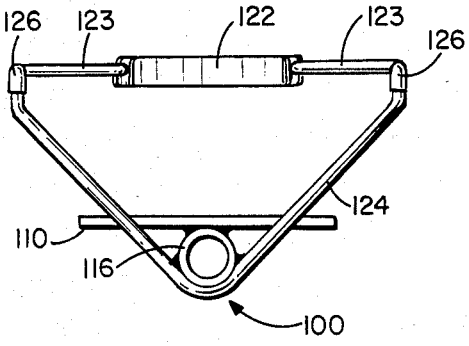
FIG. 8
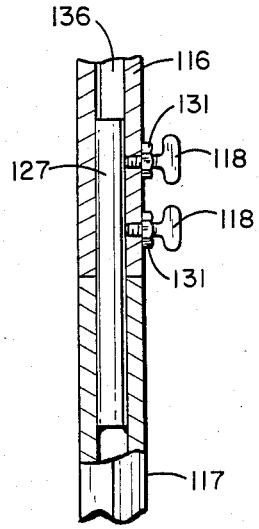
FIG. 9
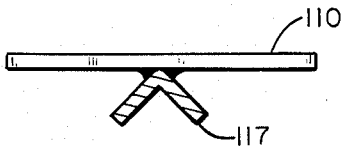
FIG. 10

SLING APPARATUS

BACKGROUND OF INVENTION

This invention relates to an apparatus for slinging an object into the environment, such as air and water. The apparatus can be used to play a modified game of golf or propel an object, such as a target, into the air. Traditionally, golf is played with a set of golf clubs, such as woods, irons and a putter. These clubs are used to stroke or hit a golf ball from a golf tee to a green having a cup or hole. One modified golf game is frisbee golf. In frisbee golf a player tosses his or her frisbee from a starting point toward a designated finishing point while keeping track of the number of tosses it takes to travel the required distance.

The use of conventional golf clubs while playing golf is disadvantageous to the handicapped and the elderly. Handicapped people who are confined to wheelchairs cannot swing conventional golf clubs. Age or a disabled arm or leg may prevent a person from using conventional clubs properly and enjoying the game of golf. Another common difficulty is that skill and coordination are required to hit and stroke golf balls with conventional golf clubs. Often a player must practice many hours before playing a golf course or country club.

SUMMARY OF INVENTION

This invention is directed to an apparatus for propelling an object into the environment, air or water, toward a desired location. The top of the apparatus has sling means for accommodating an object, such as a ball, disk, arrow, or the like. In one form of the apparatus, a putter head is attached to the lower section thereof. The lower section can also accommodate a stake end to anchor the apparatus into the ground.

One embodiment of the invention comprises an elongated linear shaft having top and bottom sections. The sections are releasably connected to each other with fastening means. A sling is attached to the top of the shaft. A putter head is secured to the opposite end of the shaft. A spur extending from the heel of the putter is placed into the ground to stabilize the apparatus. The shaft has a hand grip on the top section below the sling. When putting on a golf green, the bottom section of the shaft is separated from the top section. The bottom section accommodating the putter head is then used to stroke a golf ball into a golf hole.

The bottom section of the shaft accommodating the putter head can be replaced with a similar section having a staked end. The staked end is located in the ground. The sling can be used to throw objects into the air for firearm target practice.

Another form of the apparatus can be used with an arrow or spear in underwater activities. The sling assembly secured to one end of an elongated linear shaft projects laterally from the shaft. The sling assembly has elastic bands that are elongated in the direction of the shaft to propel the arrow in this direction toward a target.

These and other objects and advantages of the apparatus of the invention are embodied in the following detailed description of the invention.

DESCRIPTION OF DRAWING

FIG. 7 is a front view of a modification of the sling apparatus of the invention;

FIG. 8 is an enlarged top view of FIG. 7;

FIG. 9 is an enlarged sectional view taken along the line 9—9 of FIG. 7; and FIG. 10 is an enlarged sectional view taken along the line 10—10 of FIG. 7.

DESCRIPTION OF PREFERRED EMBODIMENTS

Figure 1:
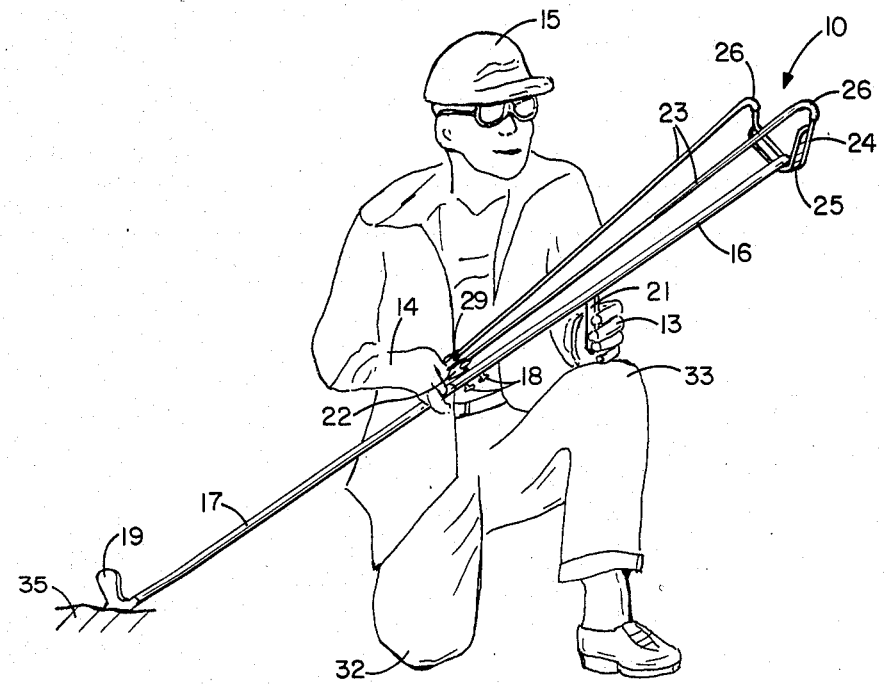
FIG. 1 is a perspective view of the sling golf apparatus of the invention held by a person in the propelling position.
Figure 2:
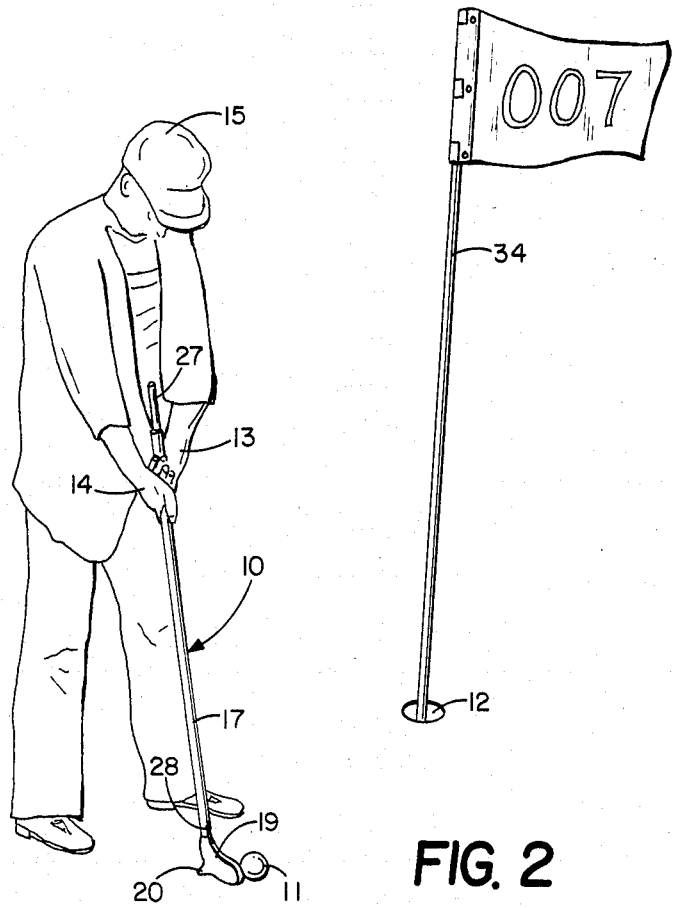
FIG. 2 is a persepctive view of the sling golf apparatus used as a putter.

Referring to FIGS. 1 to 6, there is shown a sling golf club of the invention indicated generally at 10 for playing a modified game of golf. Club 10 can be used on a conventional golf course, country club, driving range or the like. Club 10 is used to sling a golf ball 11 toward a flagstick 34 or other desired targets. As shown in FIG. 2, when short range shots are necessary, club 10 is disassembled and used to putt ball 11 into a cup or hole 12.

Figure 3:
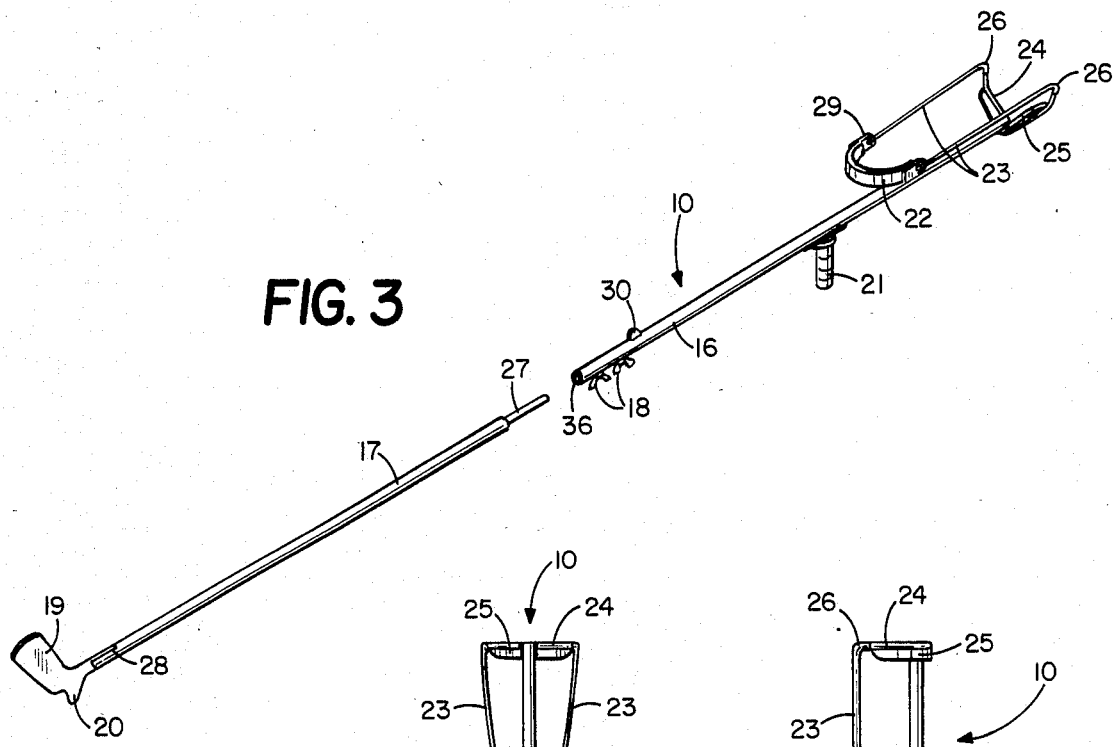
FIG. 3 is an enlarged expanded perspective view of the sling golf apparatus.
Figure 4:
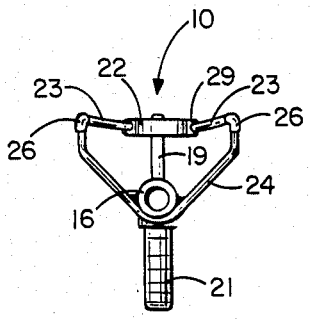
FIG. 4 is a top view of the sling golf apparatus.
Figure 5:
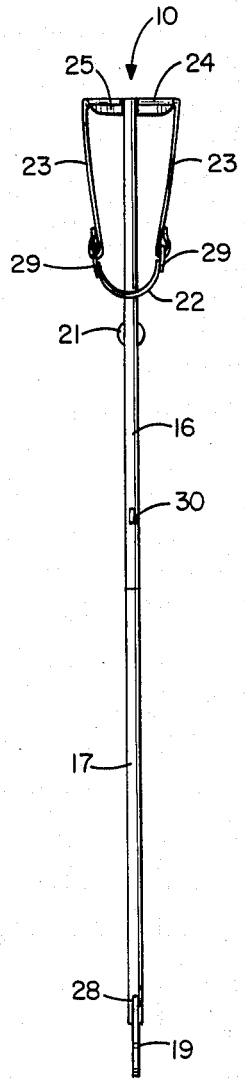
FIG. 5 is a front view of the sling golf apparatus.

Club 10 is an assembled apparatus having an upper shaft 16 and a lower shaft 17. Shafts 16 and 17 are elongated linear tubular members made of metal, plastic and like structural materials. As shown in FIG. 3, shaft 17 has a rod member 27 which fits snuggly inside bore 36 in the lower end of shaft 16. A pair of wing bolts 18 extend into the interior of shaft 16 and grip rod member 27. Wing bolts 18 screw into nuts 31 secured to shaft 16 to hold shafts 16 and 17 in an end-to-end coupled relation by gripping rod member 27.

The upper end of shaft 16 is secured to a V-shaped sling crotch 24 having diverging arms. The angle between the arms is about 90 degrees. Other angles can be used for the V-shaped member 24. Crotch 24 is supported by a V-shaped flat brace 25. The vertex of brace 25 is secured to the upper end of shaft 16. A sling band 23 is attached to each end of crotch 24 with elbow members 26. Elbow members 26 are tubular connectors located about and secured to the ends of crotch 24 and the ends of bands 23 with an adhesive and like bonding materials. The ends of the arms of crotch 24 support the tubular connectors adjacent opposite sides of a longitudinal plane located in the longitudinal axis of the shaft. Bands 23 are of uniform length and are constructed of an elastic and durable tubular plastic or rubber material having substantial elastic or spring strength. The bands 23 have high thrust capabilities. A sling pouch or strap 22 for holding golf ball 11 is located between bands 23 opposite crotch 24. A pair of connectors 29 secure bands 23 to opposite ends of pouch 22.

Attached to the middle of shaft 16 is a cylindrical-shaped hand grip 21. Grip 21 extends normal to shaft 16 opposite bands 23. Grip 21 normally projects in a downward direction, as shown in FIG. 1, to locate bands 23 and pouch 22 above shaft 16 and provides a handle to enable the shooter to hold club 10 at a desired angle. A member or indicator 30 is located adjacent wing nuts 18 on the opposite side of shaft 16 from grip 21. Member 30 provides a visual indication of the amount of elongation or stretch of bands 23 thereby indicating the propelling power of the sling bands 23.

The lower end of shaft 17 has a slot 28 to accommodate the stem of a putter 19 and facilitate the welding of the stem on shaft 17. The putter 19 has a rounded toe and flat bottom and sides. On the heel of putter 19 is a downwardly and rearwardly projected spur 20. Spur 20 is located above the plane of the bottom of putter 19 so as to not interfere with a putting stroke.

In use, as shown in FIG. 1, player 15 kneels on the ground with right knee 32 while grasping the assembled club 10 with left hand 13 at grip 21. Spur 20 is positioned in the ground 35 adjacent right knee 32. Left hand 13 and grip 21 are placed on the bent lift knee 33 whereby club 10 is set at a selected angle in relation to the ground. Next, player 15 places the golf ball 11 in pouch 22 and draws back the pouch 22 to member 30 or another position with right hand 14 thereby stretching elastic bands 23. Club 10 is aimed at a flagstick 34 marking hole 12. Finally, pouch 22 is released by right hand 14 causing bands 23 to contract and thrust the ball 11 through crotch 24 and toward hole 12 or desired target. The positions of the hands 13 and 14 and knees 32 and 33 may be switched for left handed slinging.

On the putting surface, player 15 disassembles club 10 by releasing wing bolts 18 from the nuts 31 on shaft 16. Upper shaft 16 is separated from lower shaft 17. As shown in FIG. 2, player 15 straddles ball 11 in a conventional putting stance. The player 15 grips the top of the shaft 16 and putts ball 11 with putter 19 toward hole 12 and sometimes into hole 12.

A modification of the invention is shown in FIGS. 7 to 10. A target throwing apparatus indicated generally at 100 is used to propel objects such as balls, clay pidgeons and the like, into the air for firearm shooting practice.

Thrower 100 has an upper shaft 116 and a lower shaft 117. Shafts 116 and 117 are elongated linear members made of metal or plastic. Shaft 117 is a right angle iron having a lower end 109. Shaft 117 has an inner rod member 127 which fits tightly inside bore 136 in the lower end of shaft 116. A pair of wing bolts 118 extend into the interior of upper shaft 116 and engage rod 127. Wing bolts 118 screw into nuts 131 secured to shaft 116 hold shafts 116 and 117 in an end-to-end coupled relation.

The upper end of shaft 116 is secured to a V-shaped sling crotch 124. Crotch 124 is supported by a V-shaped brace 125. The vertex of brace 125 is secured to shaft 116. Sling bands 123 are attached to each end of crotch 124 with tubular elbow members 126. Bands 123 are constructed on an elastic, durable material, such as elastic plastic or rubber, giving the bands high thrust capabilities. A sling pouch 122 is located between bands 123 opposite crotch 124. A pair of straps or connectors 129 secure bands 123 to opposite ends of pouch 122.

The lower shaft 117 has a staked end 109. A cross beam 110 attached to shaft 117 is used to drive the staked end 109 into the ground to anchor thrower 100 in the ground.

In use, an object such as a small wood block, clay disk, or tennis ball is placed in pouch 122. A shooter draws back pouch 122 to elongate elastic bands 123. The pouch 122 is then released causing bands 123 to thrust the object through crotch 124 and into the air. The object becomes an airborne target for the shooter.

Figure 6:
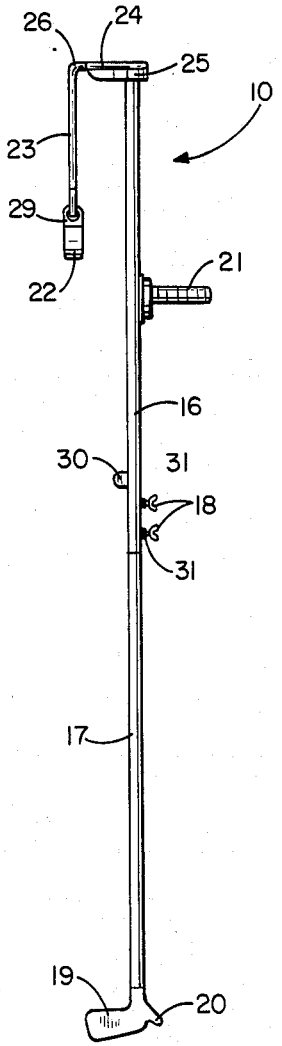
FIG. 6 is a side view of the sling golf apparatus.

Shaft 116 can be provided with a hand grip or handle, such as grip 21 shown in FIG. 6, to facilitate the use of thrower 100. An indicator member, such as member 30 shown in FIG. 6, can be added to shaft 116. Other types of indicators, such as scale lines can be added along the length of shaft 116 to provide means to determine the propelling power of bands 123.

While there has been shown and described preferred embodiments of the sling golf club and target thrower of the invention, it is understood that changes in structure, materials, sizes, shapes and arrangement of parts can be made by those skilled in the art without departing from the invention. The invention is defined in the following claims.

I claim:

1. An apparatus for directing a ball toward a desired target comprising: an elongated shaft means having a first shaft and a second shaft connected in end-to-end relation, said first shaft having an upper end remote from the second shaft, said second shaft having a lower end remote from the first shaft, means releasably holding the first and second shafts together, sling means mounted on the upper end of the first shaft for propelling an object toward a selected target, and a putter head mounted on the lower end of the second shaft for stroking the ball along the ground toward the target.

2. The apparatus for claim 1 wherein: the means releasably holding the first and second shafts together comprise a rod extended from one shaft into the other shaft to couple the first and second shafts in an end-to-end relation, and fastening means cooperating with the other shaft and the rod to releasably hold the rod in assembled relation with the other shaft.

3. The apparatus of claim 1 wherein: the putter head has a heel portion and a spur member extended from said heel portion thereof to support the shaft means on the ground.

4. The apparatus of claim 1 including: a hand grip attached normal to the first shaft adjacent the sling means.

5. The apparatus of claim 1 wherein: the sling means comprises a generally V-shaped member secured to the upper end of the first shaft, elastic bands attached to the V-shaped member, and means for accommodating the ball attached to the elastic bands.

6. The apparatus of claim 5 wherein: the V-shaped member has a vertex secured to the upper end of the first shaft and extends generally normal to said first shaft, said V-shaped member having ends located on opposite sides of a longitudinal plane along the longitudinal axis of the first shaft, said bands being secured to said ends of the V-shaped member.

7. The apparatus of claim 6 including: hand grip means attached to the mid-section of the first shaft, said hand grip means extended generally normal to said first shaft in a direction opposite the normal extension of said V-shaped member.

8. An apparatus for directing a ball toward a desired target comprising: an elongated shaft means having a first shaft and a second shaft connected in end-to-end relation, said first shaft having a first end remote from the second shaft, said second shaft having a second end remote from the first shaft, means releasably holding the first and second shafts together comprising a rod extended from one shaft to the other shaft to couple the first and second shafts in end-to-end relation, and fastening means cooperating with the other shaft and the rod to releasably hold the rod in assembled relation with the other shaft, hand grip means attached to the first shaft and projected generally normal in a first direction from the first shaft, sling means mounted on the first end of the first shaft for propelling a ball toward a selected target, and a putter head mounted on the second end of the second shaft for stroking the ball along the ground toward the target.

9. The apparatus of claim 8 wherein: the putter head includes a spur member adapted to extend into the ground.

10. The apparatus of claim 8 wherein: the sling means comprises a generally V-shaped member having a vertex secured to the first end of the first shaft, elastic bands attached to the V-shaped member, and means for accommodating the object attached to the elastic bands.

11. The apparatus of claim 10 wherein: the V-shaped member has said vertex secured to the first end of the first shaft and extends generally normal to said first shaft, said V-shaped member having ends located on opposite sides of a longitudinal plane extended along the longitudinal axis of the first shaft, said bands being secured to said ends of the V-shaped member.

12. The apparatus of claim 11 wherein: said hand grip means is attached to the mid-section of the first shaft, said hand grip means extended normal to said first shaft in a direction opposite the generally normal extension of said V-shaped member.

13. An apparatus for propelling a ball toward a desired target comprising: an elongated linear shaft means having a first end and a second end remote from the first end, and sling means mounted on the first end for propelling the object into the environment, hand grip means attached to the shaft means between the first and second ends thereof and projected generally normal in a first direction from the shaft means, putter head means attached to the second end of the shaft means for stroking the ball along the ground toward the target, said sling means having a member secured to the first end of the shaft means and extended generally normal therefrom, and elastic means secured to said member adapted to be elongated in a direction generally parallel to the lonitudinal extent of said elongated shaft means to provide the motive force to propel a ball toward a desired target.

14. The apparatus of claim 13 wherein: the shaft means has a first shaft and a second shaft releasably secured together in end-to-end relation, one of said shafts having a rod, the other of said shafts having means to accommodate said rod to couple said shafts together, and fastening means cooperating with one of said shafts and rod to releasably hold the first and second shafts together.

15. The apparatus of claim 13 wherein: the putterhead means includes a spur member adapted to extend into the ground.

16. The apparatus of claim 13 wherein: said member attached to the first end comprises a generally V-shaped member, said elastic bands being attached to the V-shaped member, and means for accommodating the ball attached to the elastic bands.

17. The apparatus of claim 16 wherein: the V-shaped member has a vertex secured to the first end of the shaft means and extended normal to said shaft means in a second direction opposite the first direction, said V-shaped member having ends located on opposite sides of a longitudinal plane positioned along the longitudinal axis of the shaft means, said bands being secured to said ends of the V-shaped member.

18. The apparatus of claim 17 wherein: said hand grip means extends generally normal to the longitudinal axis of said shaft means in a direction opposite the normal extension of said V-shaped member.

* * * * *